US008678651B2

(12) United States Patent
Schwallie et al.

(10) Patent No.: US 8,678,651 B2
(45) Date of Patent: Mar. 25, 2014

(54) DISPOSABLE STORAGE BAGS

(75) Inventors: Stephen R. Schwallie, Lake Villa, IL (US); Linda A. Holland, Racine, WI (US); Jamie Grace Thomas, Milwaukee, WI (US); Stacey M. Stanley, Lansing, MI (US); Robert R. Turvey, Sanford, MI (US); Brian A. Czech, Allen Park, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 468 days.

(21) Appl. No.: 12/805,206

(22) Filed: Jul. 19, 2010

(65) Prior Publication Data

US 2012/0014622 A1 Jan. 19, 2012

(51) Int. Cl.

| | |
|---|---|
| ***B65D 33/16*** | (2006.01) |
| ***B65D 33/00*** | (2006.01) |
| ***B65D 30/20*** | (2006.01) |

(52) U.S. Cl.

USPC ..... 383/42; 383/120; 383/105; 383/107; 383/65; 383/35

(58) Field of Classification Search

USPC ..... 383/42, 120, 105, 104, 65, 907, 35; 215/11.3

See application file for complete search history.

(56) References Cited

U.S. PATENT DOCUMENTS

| | | | | |
|---|---|---|---|---|
| 1,171,431 | A | 2/1916 | Gorton | |
| 1,680,151 | A | 8/1928 | Kauffmann | |
| 2,008,314 | A * | 7/1935 | Russell | 24/30.5 R |
| 2,286,465 | A | 6/1942 | Clement | |
| 3,174,644 | A * | 3/1965 | Kaltman et al. | 221/63 |
| 3,251,390 | A | 5/1966 | Evans | |
| 3,276,670 | A * | 10/1966 | Harvey | 383/77 |
| 3,526,317 | A | 9/1970 | Vanders | |
| 3,741,778 | A * | 6/1973 | Rowe | 426/107 |
| 3,799,914 | A * | 3/1974 | Schmit | 426/85 |
| 3,871,542 | A * | 3/1975 | Hammer | 215/11.3 |
| 4,714,164 | A | 12/1987 | Bachner | |
| 4,869,912 | A * | 9/1989 | McCoy et al. | 426/123 |
| 5,030,211 | A * | 7/1991 | Zakroczymski | 604/262 |
| 5,228,234 | A | 7/1993 | de Klerk et al. | |
| 5,356,398 | A * | 10/1994 | Willis | 604/321 |
| 5,375,930 | A * | 12/1994 | Tani | 383/206 |
| 5,738,893 | A * | 4/1998 | Kornet et al. | 426/413 |
| 5,836,056 | A | 11/1998 | Porchia et al. | |
| D402,196 | S * | 12/1998 | Lynch | D9/709 |
| 5,924,560 | A | 7/1999 | Swart | |
| 6,050,432 | A * | 4/2000 | Koehnke | 215/11.3 |
| 6,126,318 | A * | 10/2000 | Bell | 383/209 |
| 6,261,000 | B1 * | 7/2001 | Bois | 383/120 |
| D458,121 | S * | 6/2002 | Ichikawa | D9/709 |
| 6,576,278 | B1 * | 6/2003 | Sprehe | 426/117 |

(Continued)

*Primary Examiner* — J. Gregory Pickett
*Assistant Examiner* — Latrice Byrd

(57) ABSTRACT

Disposable storage bags are disclosed having a first side wall, a second side wall and a bottom portion which forms the bag and having an open top portion for receiving and removing items to be stored such as snack foods or other material. Near the top opening of the bag is a closure mechanism for opening and closing the bag. The side walls of the bag are tapered inwardly from the top portion toward the bottom portion such that quillons are formed when the bag is filled with items such as snack food or other material. The bottom portion of the bag includes a gusset which, when the bag is filled with snack food or other material, expands and opens such that the bag may stand upright.

4 Claims, 2 Drawing Sheets

(56) References Cited

U.S. PATENT DOCUMENTS

| | | | | |
|---|---|---|---|---|
| 6,783,826 | B2 * | 8/2004 | Sherrod et al. | 428/35.7 |
| 6,827,491 | B2 | 12/2004 | Kohl et al. | |
| 6,871,447 | B2 | 3/2005 | Weder et al. | |
| 7,073,674 | B2 * | 7/2006 | Knuth et al. | 215/11.3 |
| 7,137,736 | B2 | 11/2006 | Pawloski et al. | |
| 7,270,480 | B2 * | 9/2007 | Price | 383/120 |
| 7,467,893 | B2 * | 12/2008 | Sprehe | 383/63 |
| 8,070,359 | B2 * | 12/2011 | Taheri | 383/66 |
| 8,109,671 | B1 * | 2/2012 | Baker et al. | 383/35 |
| 2002/0168118 | A1 * | 11/2002 | Price | 383/64 |
| 2004/0247208 | A1 * | 12/2004 | Krohne | 383/42 |
| 2005/0276524 | A1 * | 12/2005 | Taheri | 383/61.2 |
| 2006/0191985 | A1 | 8/2006 | Norcom | |
| 2006/0193541 | A1 | 8/2006 | Norcom | |
| 2009/0142008 | A1 * | 6/2009 | Bohn et al. | 383/64 |
| 2009/0148078 | A1 * | 6/2009 | Skyler | 383/42 |
| 2009/0245698 | A1 * | 10/2009 | Miller | 383/106 |

* cited by examiner

FIG. 1
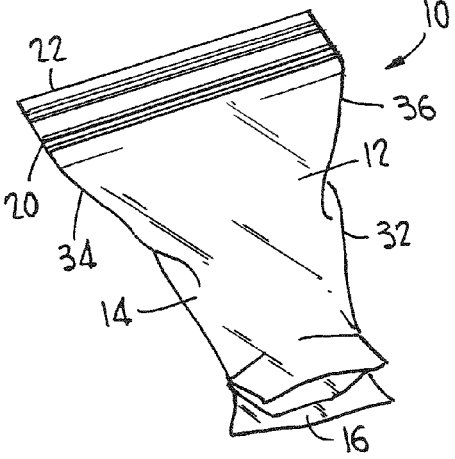
FIG. 2
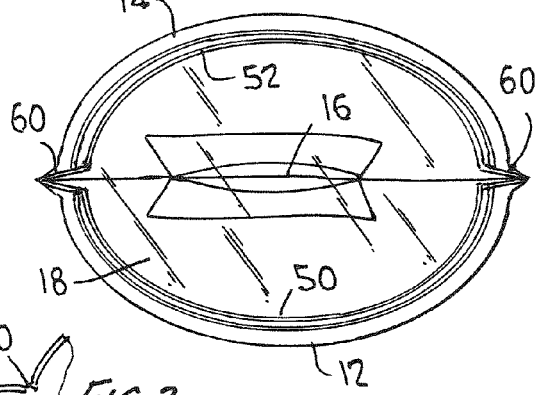
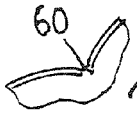
FIG. 3
FIG. 4
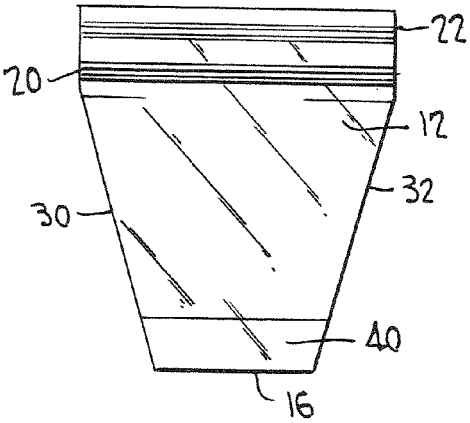
FIG. 7
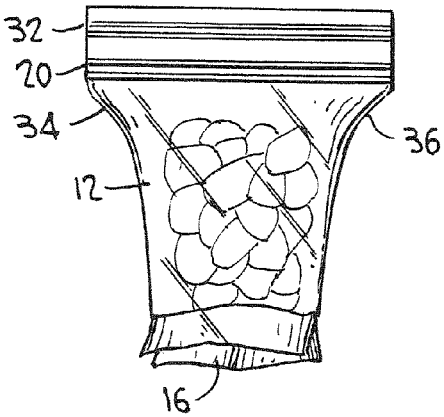
FIG. 8
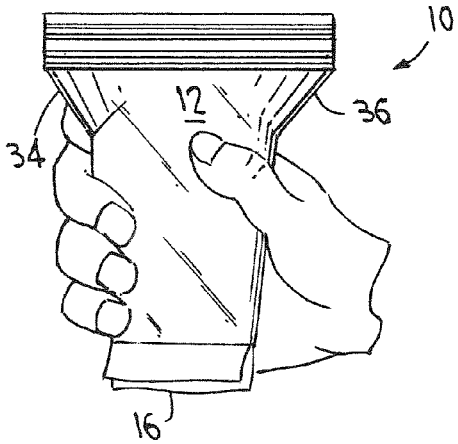
FIG. 9
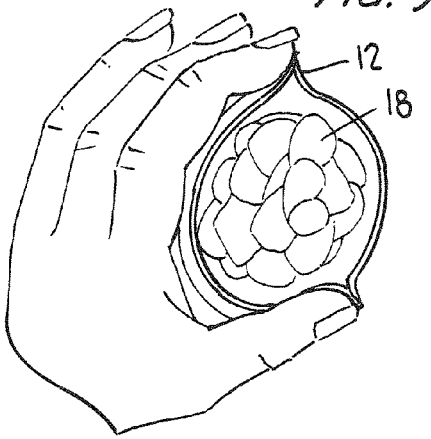

DISPOSABLE STORAGE BAGS

FIELD OF INVENTION

The present invention relates to storage bags. More specifically, the invention is directed to disposable storage bags for food and the like which provide an ergonomically tapered re-closable bag with quillons.

BACKGROUND OF THE INVENTION

Disposable storage bags are well known in the art. For example, ZIPLOC® brand bags provide a very good and useful re-closable storage bag for storing food or other material.

Most storage bags include a first side panel and a second side panel which side panels are sealed at the edges and the bottom forming the bag having an open top. These bags include re-closable closure mechanisms near the top portion of the bag for opening and closing the bag. Conventionally, the bags are square or rectangular.

While the current storage bags are quite useful in storing snack foods and the like, there is room for improvement including in providing an ergonomically tapered re-closable bag that forms a comfortable and easy-to-hold snack food or small portion dispensing system.

SUMMARY OF INVENTION

The present invention is directed to disposable storage bags having a first side wall, a second side wall and a bottom portion which forms the bag and having an open top portion for receiving and removing items to be stored, such as snack foods or other material. The side walls of the bag are tapered inwardly from the top portion toward the bottom portion. The bottom portion of the bag includes a gusset. The bag further includes a closure mechanism near the open top of the bag, such as a zipper closure, which provides for a re-closable bag. Additionally, the bag may include cuts in the bag side edges near the zipper to allow the bag mouth to open more fully when filling the bag and when removing items from the bag such as snack food. When the bag is filled with snack food or other material, quillons are formed near the top of the bag. The bottom portion expands due to the gusset and opens to provide feet providing a base portion.

The present invention further includes a dispensing container for the bags of the invention. The dispensing container includes a first flap which when opened allows for removal of bags as needed from the container. When the bags are removed from the dispensing container, the bags are generally flat. The dispensing container includes a second flap comprising a horizontal panel having end flaps which provide vertical legs to allow this panel to stand upright when opened. The panel may include one or more cut-outs which when removed from the panel provides for an opening for receiving the bag. The empty bag may be placed in the opening and then filled with items such as snack food or other material. The flap can be the top panel of the container and used to reclose the container, or can be a separate element which when not in use folds against an outside wall of the container.

The disposable bag of the present invention, therefore, provides for an ergonomically tapered re-closable bag that forms a comfortable and easy to hold dispensing system for snack food or other material. The bag is designed such that when it is filled with items such as snack food, two quillons form at each side near the closure mechanism which aid in holding the bag. Unlike standard disposable bags for snack foods or other material, the bag of the present invention can be held in an open position by using the thumb and forefinger and applying a little force at each end of the closure mechanism. When the bag includes cuts in the bag edges near the closure mechanism, the bag opens more fully allowing for easier removal of the contents of the bag. The gusseted bottom portion, in addition to allowing for expansion of the bag, may allow the bag to stand in an upright position depending on the weight of the stored material.

The different embodiments of the invention will be apparent from the following description of the preferred embodiments of the invention and from the accompanying drawings.

BRIEF DESCRIPTION OF THE DRAWINGS

The following detailed description of specific non-limiting embodiments of the present invention can be best understood when read in conjunction with the following drawings, where like structures are indicated with like reference numbers.

FIG. 1 is a front perspective view of the bag of the present invention.

FIG. 2 is a top view of the bag of the invention when in the open position.

FIG. 3 is a partial enlarged view of an optional cut in the bag side edges near the closure mechanism of the bag shown in FIG. 2.

FIG. 4 is a front view of the bag of the invention when not in use in a flattened position.

FIG. 7 is a front view of the bag of the invention filled with material to be stored in the bag.

FIG. 8 is a front view of the bag of the invention when filled with material being held by the user.

FIG. 9 is a top perspective view of the bag illustrating the bag being held in an open position by using the thumb and forefinger at each end of the closure mechanism of the bag.

DETAILED DESCRIPTION OF THE PREFERRED EMBODIMENTS

Figure 10:
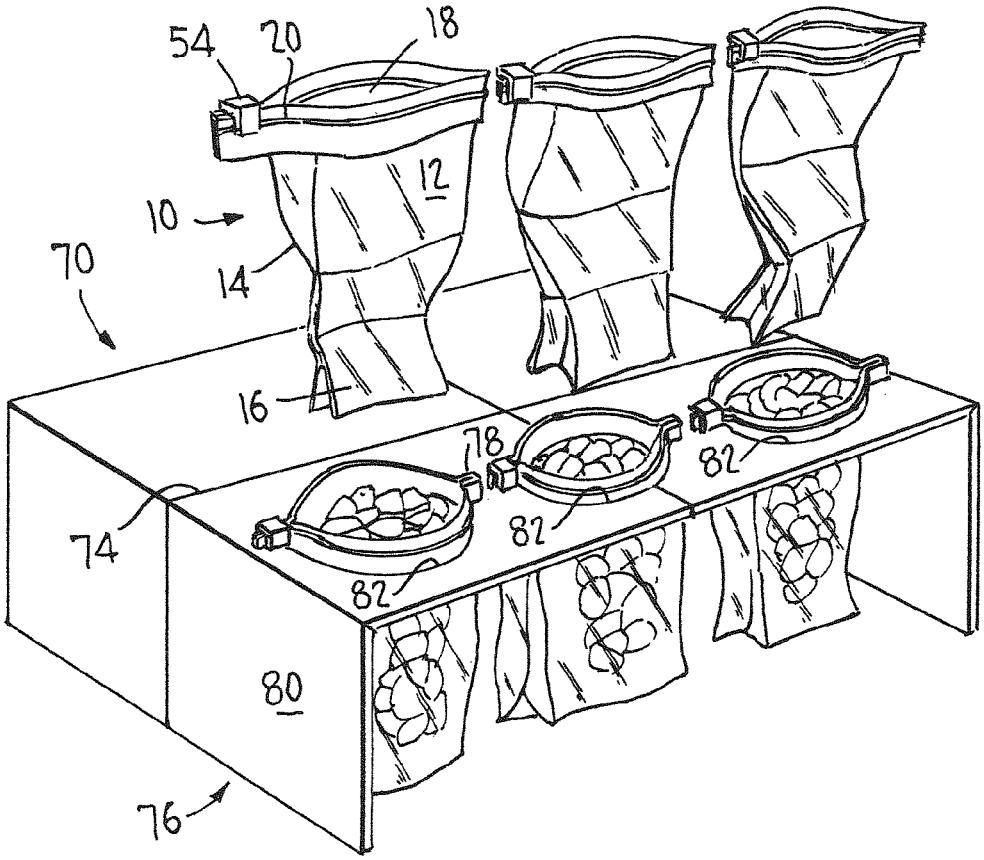
FIG. 10 is a perspective view of a dispensing container for the bag with extended filling device.

The present invention relates to an ergonomically tapered re-closable bag that forms a comfortable and easy-to-hold dispensing system for snack foods or other material. In the present description of the preferred embodiments, the invention will be described for holding snack foods. However, it is understood that the invention is useful for other material and is not so limited.

The bag of the present invention when filled with a snack product forms two quillons at each end of the closure mechanism which aids in the holding of the bag. Unlike standard snack food bags, the bag of the present invention can be held in an open position by using the thumb and forefinger and applying a little force at each end of the closure mechanism which mechanism is resilient in structure. This allows for easy filling of the bag with a snack food.

The bag 10 of the present invention includes a first side wall 12, a second side wall 14 and a bottom portion 16 which when sealed forms the bag 10 having an opening 18. Near the opening 18 is a closure mechanism 20 for opening and closing the bag. Above the closure 20 are ridges 22 on each of side walls 12 and 14 which aid in gripping and opening the bag.

The bag is made out of one or more plastic material such as polypropylene, polyethylene, or bioplastic. Therefore, the bag of the present invention is a re-closable bag and is intended to be disposable.

The side walls 12 and 14 are attached along opposite longitudinal edges 30 and 32 by heat sealing or other known methods. As seen, for example, in FIG. 4 side walls 12 and 14 are tapered inwardly from the top portion thereof toward the bottom portion 16. The degree of taper depends on the size of the bag and the intended items for storage in the bag. However, the taper must be of a sufficient degree for formation of the quillons 34 and 36 when the bag is filled with a snack food. A preferred range of taper is at angles in the range of about 60° to about 80° with respect to the horizontal bottom end of the bag in a flattened position as shown in FIG. 4. A more preferred angle of taper is greater than 70°.

Figure 5:
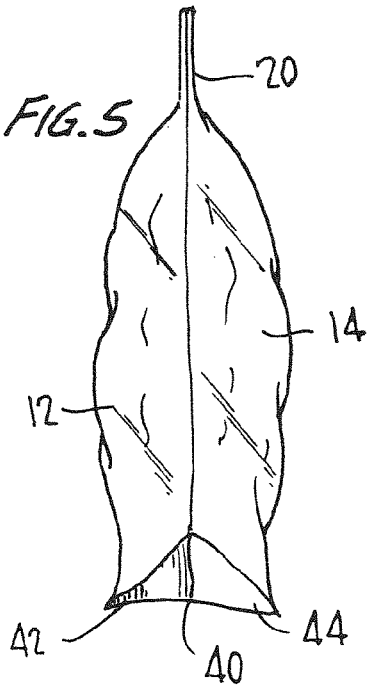
FIG. 5 is a side view of the bag of the invention when filled with material to be stored in the bag including showing the feet of the gusset.
Figure 6:
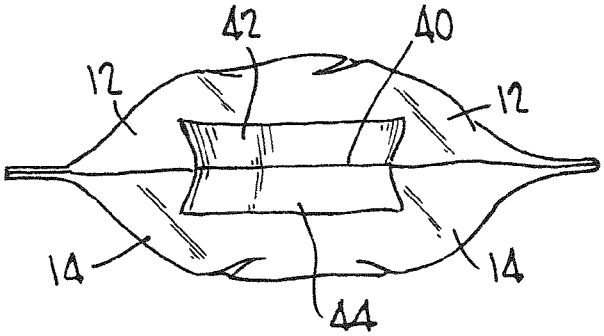
FIG. 6 is a bottom view of the bag of the invention with feet extended when filled with a material.

Referring to FIGS. 1 and 4, bottom 16 includes a gusset 40 which allows for the formation of feet 42 and 44 when the bag is filled with the snack food. When the bag is not in use and before being removed from the dispensing container, the bag is generally flat as seen in FIG. 4 and the gusset 40 and feet 42 and 44 are in a collapsed state and overlie each other. When snack food is stored in the bag, the gusset 40 expands and opens as seen in FIG. 1 such that the bag may be held upright on feet 42 and 44 as generally shown in FIG. 5.

The closure mechanism 20 may be any known closure mechanism such as a zipper as disclosed in U.S. Pat. No. 7,137,736 B2 assigned to S. C. Johnson Home Storage, Inc. and is incorporated herein by reference. The zipper in a preferred embodiment includes a single closure mechanism although multiple closure mechanisms may be used. The closure mechanism includes a female closure element 50 on side wall 12 and a male closure element 52 on side wall 14. Also, other closure mechanisms may be used such as closure mechanisms including a slide closure 54 as shown in FIG. 10. Slide closures are known in the art including as disclosed in U.S. Pat. No. 5,836,056, which is incorporated herein by reference and assigned to S. C. Johnson Home Storage, Inc. The closure mechanism is sufficiently rigid as to provide resiliency to the top portion of the bag. This aids in formation of the quillons 34 and 36 and holding the bag open as shown in FIG. 9 and discussed hereafter.

Referring to FIGS. 2 and 3, the bag includes cuts 60 in the side edges of the bag near the zipper closure mechanism. As seen in FIG. 2, the cuts will allow the bag mouth to open more fully for filling the bag with a snack food or removing a snack food from the bag.

Referring to FIG. 9, the bag of the present invention may be held in an open position by using the thumb and forefinger and applying a little force at each end of the somewhat rigid or resilient closure mechanism 20. This allows the user to hold the bag open with one hand and fill the bag with a snack food using the other hand.

Referring to FIG. 10, bags 10 may be dispensed from a container 70. When the bags are dispensed from the container they are generally flat as shown in FIG. 4. Upon dispensing the bag from container 70, the bag may be opened and filled with snack food from the top of the bag while the user holds the bag with one hand. An alternative means for filling the bag is in conjunction with dispensing container 70.

Specifically, dispensing container 70 is a rectangular box having a front wall, rear wall, end walls, top wall and bottom wall. The top wall can have a conventional opening for dispensing of bags 10. The top wall could include a first flap 72 which opens and closes along a fold line or hinge 74 to store bags 10. The container includes second flap 76 having a horizontal panel 78 and vertical legs 80 which may overlie flap 72 or fold against an adjacent side wall of the container when the container is closed and not in use. As seen in FIG. 10, flap 76 may open 180° along fold line 74 to be held in substantially the same plane as flap 72 by fold-out legs 80. Flap 76 may include one or more cut-outs 82 to hold one or more bags 10 for filling the bag. A preferred embodiment is shown in FIG. 10 having three cut-outs 82 which will allow for the filling of three bags at one time with snack food. Thereafter, the bags may be held as shown in FIG. 8 for dispensing of the snack food.

Alternatively, the dispensing container 70 can be structured so that the top wall and second flap 76 are one and the same. The top wall extends along fold line 74 and folds out to provide flap 76. Legs 80, prior to opening of dispensing container 70, are folded inside the container. Upon opening the top wall to dispense a bag, the top wall is folded outward to provide flap 76 and legs 80 folded downward to support flap 76. Use of flap 76 to fill bags is thereafter the same as described above. When not in use, flap 76 is folded back with legs 80 folded thereon so that flap 76 again forms the top wall of the container, with the legs inside the container.

The dispensing container may be made of any suitable material known to those skilled in the art such as paperboard, cardboard, plastic board or the like.

The bags of the present invention may be of various dimensions depending on the snack food to be held in the bag. However, a preferred range of dimensions are from about four to about seven inches in height with a top width to bottom width ratio of approximately 2.5 to 1. Additionally, the bags may be designed to fit into a cup holder of various apparatus, including automobiles, boats, furniture, or the like.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

We claim:

1. A flexible bag comprising:

first and second flexible wall panels coupled together to form a bag with opposing sealed side edges, a sealed bottom end, and an open top end, wherein the side edges taper inwardly from the top end to the bottom end;

a gusset defined along the sealed bottom end; and a first elongate closure mechanism disposed along the first wall panel at the open top end and a second elongate closure mechanism disposed along the second wall panel at the open top end, wherein the first closure mechanism selectively interlocks and unlocks with the second closure mechanism; and wherein the first closure mechanism and the second closure mechanism provide a resiliency at the open top end that in combination with the tapered side edges facilitate formation of an extended side wall portion relative to a remaining side wall portion extending therebelow to the bottom end at each of the side edges of the bag proximate the first closure mechanism and the second closure mechanism when the bag is filled with a product to provide a gripping area in said remaining side wall portion;

wherein when the bag does not contain product the bag is substantially flat and remains tapered along the side edges;

wherein the gusset along the sealed bottom end of the bag is constructed to allow the bag to stand in an upright position; and wherein the bag is constructed and arranged to be held in an open position by a user's thumb and forefinger and application of force at each end of the first closure mechanism and the second closure mechanism.

2. The flexible bag of claim 1 wherein the taper has an inward degree of taper in a range of about 60° to about 80°.

3. The flexible bag of claim 1 wherein each of the side edges includes a V-shaped notch therein adjacent the first closure mechanism and the second closure mechanism to facilitate expansion of the open top end of the bag.

4. The flexible bag of claim 1 wherein the bag is made from at least one plastic selected from the group consisting of polypropylene, polyethylene and bioplastics.

* * * * *